US007901040B2

(12) United States Patent
Drury

(10) Patent No.: US 7,901,040 B2
(45) Date of Patent: Mar. 8, 2011

(54) DROPLET DEPOSITION METHOD AND APPARATUS

(75) Inventor: Paul Raymond Drury, Hertfordshire (GB)

(73) Assignee: Xaar Technology Limited, Cambridgeshire (GB)

( * ) Notice: Subject to any disclaimer, the term of this patent is extended or adjusted under 35 U.S.C. 154(b) by 432 days.

(21) Appl. No.: 11/994,556

(22) PCT Filed: Jul. 7, 2006

(86) PCT No.: PCT/GB2006/002544

§ 371 (c)(1), (2), (4) Date: Mar. 19, 2008

(87) PCT Pub. No.: WO2007/007074

PCT Pub. Date: Jan. 18, 2007

(65) Prior Publication Data

US 2009/0128603 A1 May 21, 2009

(30) Foreign Application Priority Data

Jul. 7, 2005 (EP) ..... 05106209

(51) Int. Cl.
*B41J 2/14* (2006.01)

(52) U.S. Cl. ..... 347/47; 347/71

(58) Field of Classification Search ..... 347/47, 347/64–65, 68–71, 40, 43
See application file for complete search history.

(56) References Cited

U.S. PATENT DOCUMENTS

| | | | | |
|---|---|---|---|---|
| 4,835,554 | A | 5/1989 | Hoisington et al. | |
| 5,155,498 | A | 10/1992 | Roy et al. | 347/11 |
| 5,189,437 | A | 2/1993 | Michaelis et al. | 347/47 |
| 5,278,584 | A | 1/1994 | Keefe et al. | 347/63 |
| 5,748,214 | A | 5/1998 | Usui et al. | 347/70 |
| 5,818,485 | A | 10/1998 | Rezanka | |
| 6,158,844 | A * | 12/2000 | Murakami et al. | 347/55 |
| 6,705,704 | B2 | 3/2004 | Harvey et al. | |
| 6,908,177 | B2 * | 6/2005 | Suganuma | 347/55 |
| RE39,092 | E | 5/2006 | Horii et al. | |
| 7,275,812 | B2 * | 10/2007 | Furukawa | 347/55 |
| 2002/0051039 | A1 | 5/2002 | Moynihan et al. | |

FOREIGN PATENT DOCUMENTS

| | | |
|---|---|---|
| EP | 0 277 703 A1 | 8/1988 |
| EP | 0 278 590 | 8/1988 |
| EP | 1 140 513 | 10/2001 |
| JP | 58-187369 | 11/1983 |
| JP | 2001-096753 | 4/2001 |
| WO | WO-89/02577 | 3/1989 |
| WO | WO 01/08888 | 2/2001 |

OTHER PUBLICATIONS

International Search Report for PCT/GB2006/002544 dated Oct. 31, 2006.

International Preliminary Report on Patentability for Application No. PCT/GB2006/002544, dated Jan. 17, 2008.

* cited by examiner

*Primary Examiner* — Lamson D Nguyen

(74) *Attorney, Agent, or Firm* — Marshall, Gerstein & Borun LLP

(57) ABSTRACT

In an ink jet printhead have an elongate ink chamber and a nozzle at one end, a continuous flow of ink is provided through a high impedance channel communicating with the chamber close to the nozzle. Ink is ejected through the nozzle by generating longitudinal acoustic waves in the fluid chamber. A high velocity ink flow into the chamber from the channel sweeps away from the nozzle debris or bubbles that might otherwise block the nozzle.

19 Claims, 2 Drawing Sheets

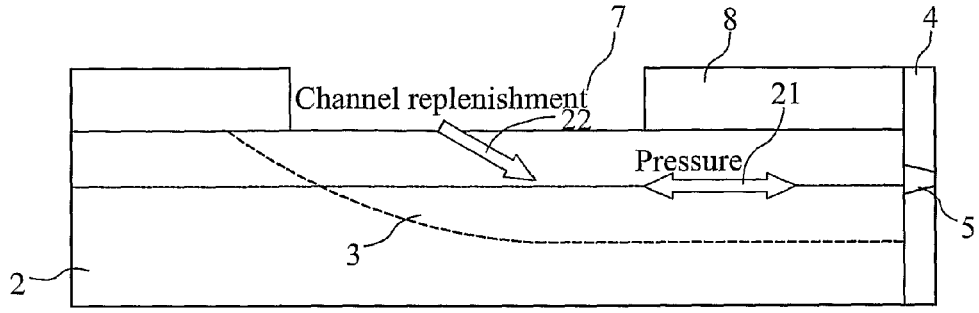
*Fig. 2* *Prior Art*
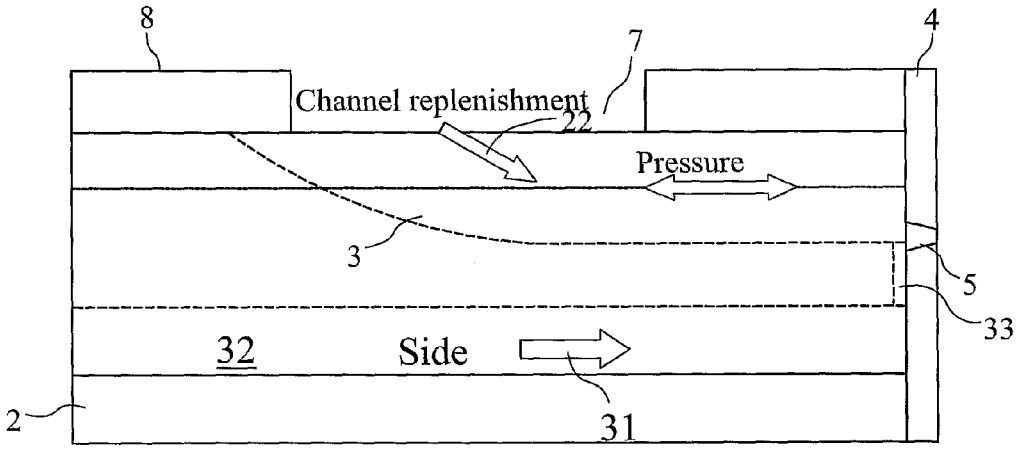
*Fig. 3*
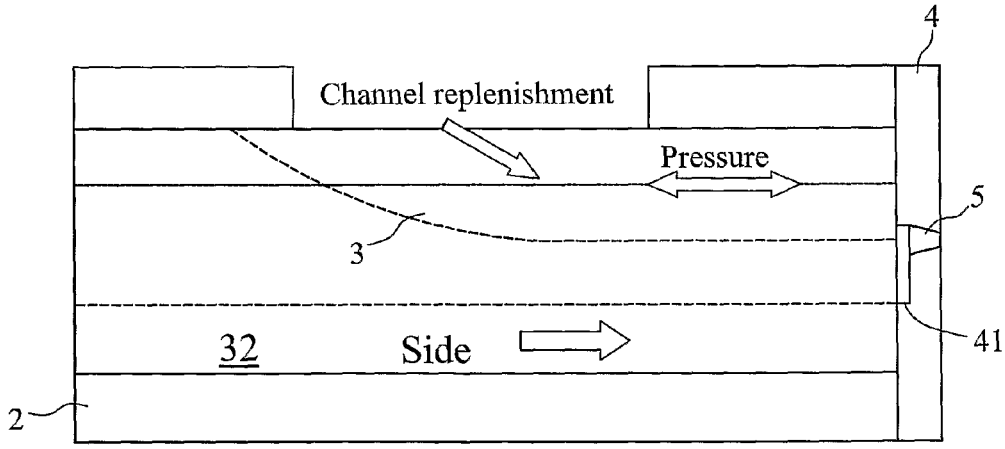
*Fig. 4*

DROPLET DEPOSITION METHOD AND APPARATUS

BACKGROUND OF THE INVENTION

1. Field of the Invention This invention relates to droplet deposition methods and apparatus in which droplets are ejected from a chamber via a nozzle.

2. Related Technology

In a known apparatus (see for example EP-A-0 277 703 and EP-A-0 278 590) an elongate ink chamber has one or more of the longitudinally extending walls formed of piezoelectric material. By the application of an electric field in a direction appropriate to the poling of that piezoelectric material, the wall can be caused to move into and out of the ink chamber to establish longitudinal acoustic waves in the ink. With appropriate timing of the actuating waveform and with appropriate acoustic reflection at the ends of the chamber, one or a controlled succession of droplets can be ejected through the nozzle.

The nozzle may be situated at one end of the elongate ink chamber in the so-called "end shooter" arrangement or towards the middle of the chamber in the "side shooter" arrangement.

In a printer or other droplet deposition apparatus, care is obviously taken to avoid contamination with (or to remove from the ink) debris or bubbles, which might cause blockage of a nozzle. The occurrence of debris or bubbles cannot however be avoided completely; some debris may be generated through manufacturing irregularities within the printhead and some bubbles may unavoidably form within the printhead as a direct result of the fluid pressure changes that accompany droplet ejection.

To address this problem, it has been suggested to provide in both side shooter and end shooter configurations, a continuous flow of ink past the nozzle in an attempt to sweep away from the nozzle any debris or bubbles which would otherwise cause blockage at the nozzle. This continuous flow occurs whilst the printer is printing and whilst the printer is not printing so that the continuous flow is preferably greater than, and it has been suggested up to ten times greater than, the maximum flow rate through the nozzle.

The continuous or persistent ink flow through the channel can provide significant improvements to the uniformity and reliability of operation. Prior to printing the flow can be used to purge any debris or air from the nozzle, channel, ink manifolds or ink supply system and where necessary the system can include thermal control. Prior to printing it is often necessary to have the system reach thermal stability. During printing and depending upon the pattern to be formed different parts of the actuator are likely to operate at different duties which without constant flow are known to lead to differing operating temperatures increasing the risk of both minor and catastrophic image defects.

The side-shooter with constant recirculation is known to reduce the impact of certain defects by either reducing the time the channel and nozzle are exposed or providing a self-priming mechanism. Some of these are listed below:

| Cause of Failure | Effect |
|---|---|
| Vibration | Displacement or breakage of nozzle meniscus |
| Debris (dirt) | Causes local viscosity distortion can disrupt flow<br>Can inhibit fluid ejection at the nozzle |
| Debris (air) | Large air bubbles starve nozzle/channel of fluid |

-continued

| Cause of Failure | Effect |
|---|---|
| | Small air bubbles reduce acoustic efficiency (increase compliance)<br>Bubbles within the channel will grow due to rectified diffusion |
| Ingested air | Accumulated air ingested at the nozzle |
| Viscosity | Changes to the viscosity of the fluid at a macro scale, due to mild flocculation or contamination, for example. |

The provision of a continuous flow past the nozzle is relatively straightforward in the side shooter configuration. Reference is directed in this regard to EP-A-1 140 513. In this prior proposal, both ends of the ink chamber remain open, simplifying the provision of a relatively high flow rate continuously past the nozzle. This flow across the nozzle is orthogonal to the direction along which droplets are ejected and is thus particularly effective in sweeping debris and bubbles away from the nozzle.

The provision of a continuous flow through the ink chamber is not straightforward in an end shooter configuration. In a prior proposal (see for example U.S. Pat. No. 6,705,704) a barrier divides the ink chamber longitudinally. In use, a continuous ink flow is established in a U-shaped path in the chamber: towards the nozzle on one side of the barrier, across the nozzle, and away from the nozzle on the other side of the barrier. This arrangement has advantages but is not appropriate in all circumstances.

SUMMARY OF THE INVENTION

The invention provides an improved droplet deposition method and apparatus in which the beneficial effects of a relatively high flow rate of liquid past the nozzle can be achieved in the "so-called" end shooter configuration.

Accordingly, the present invention provides in one aspect in droplet deposition apparatus comprising an elongate fluid chamber for containing droplet deposition liquid; a nozzle associated with one end of the chamber for droplet ejection; a high impedance channel communicating with the chamber at said end; actuation means associated with the chamber to effect droplet ejection through the nozzle by generating longitudinal acoustic waves in the fluid chamber; and fluid supply means adapted to supply fluid to the chamber and through the high impedance channel.

Preferably, the high impedance channel has an outlet immediately adjacent the nozzle.

Suitably, the high impedance channel is directed orthogonally of the length of the fluid chamber.

Advantageously, the high impedance channel communicates between the chamber and a supply manifold that remains of constant volume on droplet ejection.

Preferably, the high impedance channel is directed orthogonally of the direction of droplet ejection through the nozzle.

In one form of the invention, the impedance of the high impedance channel is at least five and preferably at least ten times greater than that of the fluid chamber.

In one form of the invention, the cross-sectional area of the fluid chamber is at least five and preferably at least ten times greater than that of the high impedance channel.

The flow of liquid through the high impedance channel into the chamber may be at least equal to, at least twice, at least five times or at least ten times the maximum flow through the nozzle on droplet ejection.

The velocity of liquid flow from the high impedance channel across the nozzle may be at least equal, at least twice, at least five times or at least ten times the maximum velocity of flow through the nozzle on droplet ejection.

The present invention consists in another aspect in a method of droplet deposition from an elongate fluid chamber containing droplet deposition liquid and having at one end a nozzle associated with the chamber for droplet ejection; comprising the steps of establishing in the chamber a continuous flow of droplet deposition liquid along the chamber in a direction away from the nozzle, that flow entering the chamber adjacent the nozzle through a channel having a cross-sectional area substantially smaller than that of the fluid chamber; and generating longitudinal acoustic waves in the chamber to effect droplet ejection through the nozzle.

Suitably, the flow exiting the channel is directed orthogonally of the direction of droplet ejection through the nozzle.

Preferably, the flow of liquid through the high impedance channel is at least twice, preferably at least five times and more preferably at least ten times the maximum flow through the nozzle on droplet ejection.

Advantageously, the velocity of liquid flow from the high impedance channel across the nozzle is at least equal to, at least twice, at least five times or at least ten times the maximum velocity of flow through the nozzle on droplet ejection.

Surprisingly, droplets can be ejected efficiently by acoustic wave generation in the fluid chamber despite the presence of a channel in the vicinity of the nozzle providing high velocity flow past the nozzle. This is achieved by forming the channel of high impedance compared with the impedance of the fluid chamber. By providing the high impedance channel with a cross section which is small compared to that of the fluid chamber, it can be arranged (even with a continuous flow rate which is equal to or not much greater than the maximum flow rate through the nozzle on droplet ejection) that a high velocity flow is established at the nozzle to sweep away debris and bubbles.

An advantage of establishing this flow from the channel into the chamber (rather than vice versa) is that there is no tendency for bubbles or debris in the chamber to block the channel.

Preferably, the flow at the outlet of high impedance channel is directed orthogonally to the direction in which droplets are ejected and orthogonally of the length of the fluid chamber. The outlet of the high impedance channel is preferably located immediately adjacent to the nozzle; indeed the cross section of the nozzle inlet may extend into the high impedance channel.

BRIEF DESCRIPTION OF THE DRAWINGS

The invention will now be described by way of example with reference to the accompanying drawings in which:—

FIG. 2 is a longitudinal section of the ink jet printhead shown in FIG. 1;

FIG. 3 is a longitudinal section of an ink jet printhead according to one embodiment of the present invention; and FIG. 4 is a longitudinal section of an ink jet printhead according to a further embodiment of the present invention.

DETAILED DESCRIPTION

Figure 1:
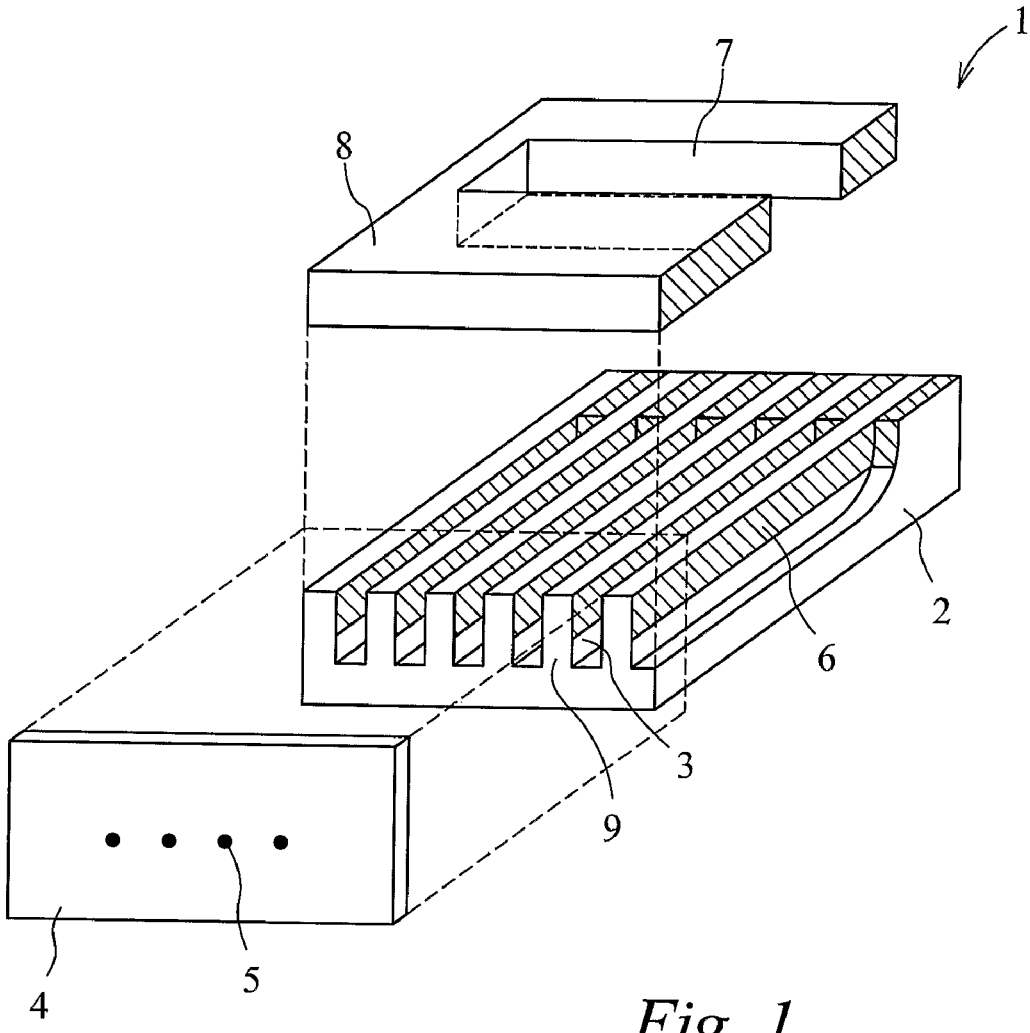
Fig. 1 Prior Art
FIG. 1 is an exploded view of a known ink jet printhead.

There is shown in FIG. 1, a conventional inkjet printhead using the action of piezoelectric material to create longitudinal acoustic waves in ink channels having nozzles in the "end shooter" configuration. The printhead 1 is provided with a piezoelectric actuator 2 which cooperates with a cover plate 8 to form elongated ink channels 3. Elongate walls 9 of piezoelectric material are shared between neighbouring channels and can move into or out of either channel to change the volume of that channel. Electrodes 6 are provided for establishing an actuating electric field across at least part of the piezoelectric wall.

Nozzles 5 are provided in a nozzle plate 4 that is secured to the piezoelectric actuator so as to close one end of each of the ink channels 3. A manifold 7 in the cover plate enables replenishment of the ink channels.

There are shown in FIG. 2 a longitudinal section through droplet deposition apparatus as shown in FIG. 1.

The effect of the transverse movement of either or both of the walls bounding each ink channel is to generate longitudinal acoustic waves shown at arrow 21. As described in more detail in EP-A-0 277 703 and EP-A-0 278 590, droplets are ejected through nozzle 5. Droplets can be ejected in binary fashion or in a greyscale mode in which a plurality of droplets merge at the nozzle before being ejected to form drops of varying sizes. Ink ejected through nozzle 5 is replaced by a channel replenishment flow shown at arrow 22, through the manifold 7 into the chamber 3.

A problem that has been identified with this construction is that debris or bubbles in the ink which are carried along the channel 3 by the channel replenishment flow will become trapped at the end of the channel adjacent to nozzle plate 4 and may cause temporary or permanent blockage of the nozzle 5. It has been determined that even a relatively small bubble, if it is allowed to remain at the end of the channel adjacent to the nozzle plate, will lead to nozzle blockage. This is because the changes in pressure in the ink which accompany droplet ejection encourage bubbles to grow in size.

An embodiment of this invention is illustrated in FIG. 3, where components which remain essentially unchanged from the arrangement shown in FIG. 2 retain the same reference numerals.

In this embodiment of the invention, an additional flow path shown at arrow 31 is established. This flow is carried in a channel 32 which extends in a direct parallel to the length of the ink chamber 3. The channel 32 may conveniently be positioned beneath the chamber 33, that is to say out of the plane which contains the array of ink channels 3 so as not to increase the spacing between adjacent channels and therefore between adjacent nozzles. The flow 31 may be specific to one ink channel 3, with there being a side flow channel 32 for each ink channel 3; alternatively, one relatively wide channel 32 might serve all or a number of the ink channel 3.

A high impedance channel 33 extends from the channel 32 to the channel 3, adjacent to the nozzle plate 5.

It should be noted that the position of the nozzle 5 with respect to the longitudinal access of the channel 3 has been adjusted so that the outlet of the high impedance channel 33 is immediately adjacent to the nozzle 5. Indeed, the cross-sectional area of the inlet to the nozzle is seen to extend into the high impedance channel 33.

The skilled man will recognise that the depiction of FIG. 3 is somewhat diagrammatic and that there exists, particularly in relation to the establishment of the side flow depicted at arrow 33, a wide variety of constructional techniques by which such a flow of ink could be established. It is important to recognise that the channel 32 or other structure supplying ink to the high impedance channel 33 is passive, that is to say that its volume does not change during droplet ejection.

In use, a side flow of ink 31 is established which is at least equal to and preferably greater than the maximum flow of ink through the nozzle on droplet ejection. Ink passes through the high impedance channel 33 and enters into the channel 3:—

Directly adjacent to the nozzle

In a direction transverse to the droplet ejection

At relatively high velocity

For these reasons, the flow is particularly effective at sweeping away from the nozzle debris which might block the nozzle and even small bubbles which, if left in position, could grow to block the nozzle. These bubbles and debris then pass along the length of the chamber 3 and exit through the manifold 7.

The flow replenishing the channel after drop ejection as illustrated at arrow 22 is dominated by the flow from the manifold adjoining the active channel due to its lower fluidic impedance than that of the channel 33. With pressures generated within the channel 3 being of the order of 1 or 2 atmospheres the replenishment fluid can reach time averaged velocities approaching 0.1 ms-1.

In the case of the acoustic operation pressure waves in the fluid within the channel propagate simultaneously with the replenishment flow and at around 500 ms-1. The replenishment flow occurs only when fluid is ejected according to the control of the pressure waves.

The magnitude of the side flow is chosen so that the time a channel is exposed to debris (and others, see above) is maintained below a certain level. For certain basic graphics applications it is accepted that occasional single nozzle defects up to 1000 pixels in length can be tolerated. Graphic images for primary applications will tolerate defects of no more than 40 pixels. Image of 'photographic' quality require less than 20 pixels. The printing of function devices (e.g. PCBs, displays, electronics, etc) will impose more stringent requirements.

A second consideration to the magnitude of the flow is fluid velocity at the rear of the nozzle. Bubbles ingested during the operation of the device will migrate toward the channel and without intervention may become lodged and significantly increase the risk of ejection failure. Depending upon the fluid type and its conditioning cavitation can act to accelerate an ejection failure. To minimise the time that debris can cause an ejection defect, the side flow is arranged to provide a fluid velocity that causes the fluid in the chamber to be swept inside of the time taken to eject 1000 pixels from a single nozzle.

The side flow velocity will depend upon the flow through the channel 33 and upon the relative cross sectional areas of the channel 33 and the chamber 3.

If the flow through the channel 33 is equal to the maximum flow through the nozzle (which will be greater than the time averaged replenishment flow by an amount depending upon the duty cycle of the chamber and the print data) and if the cross sectional area of the channel 33 is one tenth of the cross sectional area of the chamber 3 then a ten times increased flow velocity past the nozzle can be expected.

Advantageously, the side flow opposes the dominant replenishment flow so that, the active chamber is protected from the influx of dirt from the ink supply due to the smaller size of the channel providing the side flow.

A consideration in designing the re-circulating flow is the negative pressure applied to fluid which if large can induce unwanted cavitation. The described embodiment requires that the side channel provide significant impedance so that a large positive pressure must be applied to the associated manifold to generate the necessary flow velocity in the actuation chamber. Conveniently, the opposing manifold (which must provide a negative pressure for the nozzle to be maintained below atmospheric pressure) can be arranged to provide only a modest negative pressure (with atmos) so that the risk of cavitation is low.

The cross-sectional area of the high impedance channel 33 is substantially less than the cross-sectional area of the channel 3. In one arrangement, the ink channels 3 have a height of 300 μm and a width of 75 μm. The high impedance channel may extend across the width of the ink chamber 3 with a dimension of 75 μm, with a thickness (in the direction of elongation of the ink channel 3) of 30 μm, with a cross-sectional area of one tenth of the cross sectional area of the ink channel 3. In variations, the high impedance channel 33 may extend over less than the full width of the ink channel and may extend to a greater or lesser amount in the direction or elongation of the length of the channel 3.

A modification is illustrated in FIG. 4. In this case, the high impedance channel takes the form of a rebate 41 cut into the nozzle plate 4. The nozzle plate may be designed to be thicker, so as both to accommodate this rebate and to provide a nozzle of the same length as in the previously described embodiment.

Whilst the invention has been described in relation to a printhead, it will be understood that the invention applies more broadly to droplet deposition apparatus. It will similarly be understood that the high impedance channel communicating with the chamber at the nozzle end could take a variety of forms beyond those described and the described walls of piezoelectric material are only one example of actuation means associated with the chamber to effect droplet ejection through the nozzle by generating longitudinal acoustic waves in the fluid chamber.

The invention claimed is:

1. Droplet deposition apparatus comprising an elongate fluid chamber for containing droplet deposition liquid; a nozzle associated with one end of the chamber for droplet ejection; a high impedance channel communicating with the chamber at said end; an actuator associated with the chamber to effect droplet ejection through the nozzle by generating longitudinal acoustic waves in the fluid chamber; and a fluid supply adapted to supply fluid to the chamber and through the high impedance channel.

2. Apparatus according to claim 1, wherein the high impedance channel has an outlet immediately adjacent the nozzle.

3. Apparatus according to claim 1, wherein the high impedance channel is directed orthogonally of the length of the fluid chamber.

4. Apparatus according to claim 1, wherein the high impedance channel communicates between the chamber and a supply manifold that remains of constant volume on droplet ejection.

5. Apparatus according to claim 1, wherein the high impedance channel is directed orthogonally of the direction of droplet ejection through the nozzle.

6. Apparatus according to claim 1, wherein the impedance of the high impedance channel is at least five times greater than that of the fluid chamber.

7. Apparatus according to claim 1, wherein the cross-sectional area of the fluid chamber is at least five times greater than that of the high impedance channel.

8. Apparatus according to claim 1, adapted so that in use a flow of liquid through the high impedance channel into the chamber is at least equal to the maximum flow through the nozzle on droplet ejection.

9. Apparatus according to claim 8, wherein in use the flow of liquid through the high impedance channel is at least twice the maximum flow through the nozzle on droplet ejection.

10. Apparatus according to claim 8, where in use the flow of liquid through the high impedance channel is at least five times the maximum flow through the nozzle on droplet ejection.

11. Apparatus according to claim 8, where in use the flow of liquid through the high impedance channel is at least ten times the maximum flow through the nozzle on droplet ejection.

12. Apparatus according to claim 1, wherein in use the velocity of liquid flow from the high impedance channel across the nozzle is at least equal to the maximum velocity of flow through the nozzle on droplet ejection.

13. Apparatus according to claim 12, wherein in use the velocity of liquid flow from the high impedance channel across the nozzle is at least twice the maximum velocity of flow through the nozzle on droplet ejection.

14. Apparatus according to claim 12, where in use the velocity of liquid flow from the high impedance channel across the nozzle is at least five times the maximum velocity of flow through the nozzle on droplet ejection.

15. Apparatus according to claim 12, where in use the velocity of liquid flow from the high impedance channel across the nozzle is at least ten times the maximum velocity of flow through the nozzle on droplet ejection.

16. Apparatus according to claim 1, wherein the actuator comprises a body of piezoelectric material.

17. Apparatus according to claim 16, wherein the body of piezoelectric material forms at least part of the wall of the fluid chamber.

18. Apparatus according to claim 1, wherein the impedance of the high impedance channel is at least ten times greater than that of the fluid chamber.

19. Apparatus according to claim 1, wherein the cross-sectional area of the final chamber is at least ten times greater than that of the high impedance channel.

* * * * *